United States Patent [19]

Burgoon

[11] 4,327,455

[45] May 4, 1982

[54] SURFACE CLEANING MACHINE WITH HOPPER DUMPING MECHANISM

[75] Inventor: Jack L. Burgoon, Toledo, Ohio

[73] Assignee: The Scott & Fetzer Company, Lakewood, Ohio

[21] Appl. No.: 212,836

[22] Filed: Dec. 4, 1980

[51] Int. Cl.[3] ..... F01H 1/04

[52] U.S. Cl. ..... 15/83; 15/340; 298/19 R; 298/22 R; 298/23 MD

[58] Field of Search ..... 15/83–87, 15/340; 298/19 R, 22 R, 23 R, 23 MD, 27, 30

[56] References Cited

U.S. PATENT DOCUMENTS

| | | | |
|---|---|---|---|
| 2,614,279 | 10/1952 | Mott | 15/83 |
| 3,672,724 | 6/1972 | Neuzil, Sr. | 298/27 |
| 4,173,052 | 11/1979 | Burgoon et al. | 15/83 |

*Primary Examiner*—Edward L. Roberts

*Attorney, Agent, or Firm*—Allen D. Gutchess, Jr.

[57] ABSTRACT

A surface cleaning machine and particularly a riding power sweeper is provided. The sweeper has a main rotary broom and an adjacent hopper with an inlet opening for receiving dirt and debris swept from the surface by the broom. The hopper has an outlet opening spaced from the inlet opening through which dirt and debris are emptied from the hopper, and a dumping door is located adjacent the outlet opening for opening and closing the outlet opening. The dumping mechanism for the hopper includes a single drive unit which is connected to the hopper and to the dumping door. When the hopper is to be dumped, the drive unit is operated to first open the dumping door to a position against a stop. After the door contacts the stop, continued operation of the drive unit moves the hopper to a tilted dumping position in which the dirt and debris are emptied through the open outlet opening.

14 Claims, 5 Drawing Figures

SURFACE CLEANING MACHINE WITH HOPPER DUMPING MECHANISM

This invention relates to a surface cleaning machine and more specifically to a riding power sweeper with improved hopper dumping mechanism.

A power sweeper according to the invention employs a rotary broom at an intermediate point under the sweeper with a hopper being located adjacent the rotary broom. The hopper has an inlet opening communicating with the broom to receive dirt and debris therefrom swept from a surface being cleaned. The hopper also has an outlet opening through which the dirt and debris are emptied from the hopper, with a dumping door being mounted on the hopper adjacent the outlet opening for opening and closing same. The dumping door closes off the outlet opening when the sweeper is cleaning and then opens the outlet opening when the hopper is to be dumped and emptied.

Most hopper dumping mechanisms for riding power sweepers are relatively complicated, incorporating a number of linkages and usually at least two drive units. In contrast, the dumping mechanism in accordance with the invention is relatively simple and maintenance free, employing a single drive unit and no extra linkages. The drive unit includes a linear actuator or fluid-operated ram, by way of example, connected to the hopper and also to the dumping door. When the hopper is to be dumped, the drive unit is operated to first open the dumping floor, with this movement continuing until the door engages a stop. Continued operation of the drive unit then causes the hopper to move to a dumping position in which the dirt and debris are emptied through the open outlet opening.

It is, therefore, a principal object of the invention to provide a power sweeper with a hopper dumping mechanism having the features and advantages discussed above.

Many other objects and advantages of the invention will be apparent from the following detailed description of a preferred embodiment thereof, reference being made to the accompanying drawings, in which.

Figure 1:
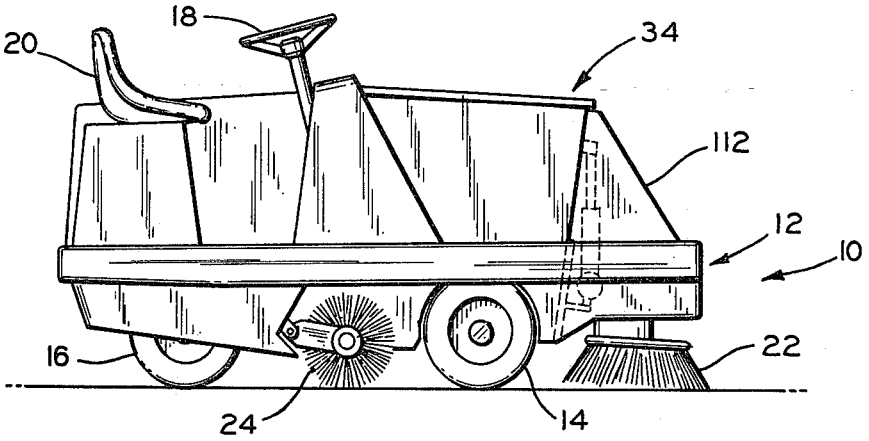
FIG. 1 is a somewhat schematic side view in elevation of a riding power sweeper embodying the invention.
Figure 2:
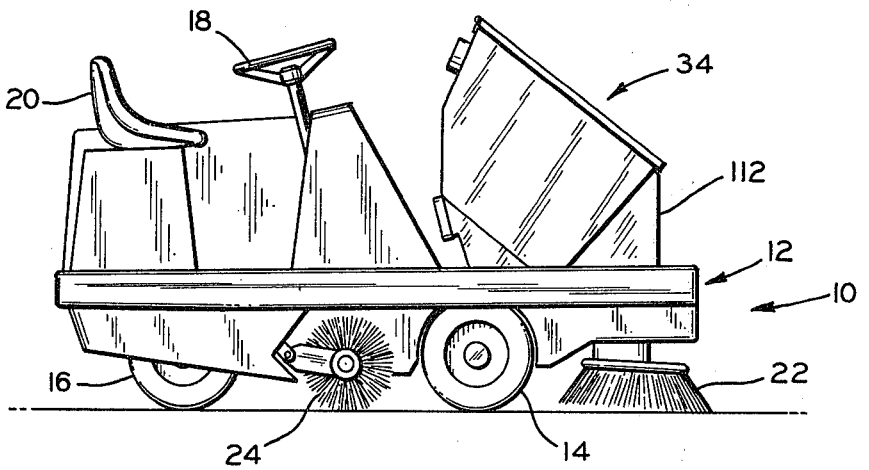
FIG. 2 is a view similar to FIG. 1 but with a dirt and debris hopper shown in a dumping position.

Referring to the drawings and particularly to FIGS. 1 and 2, a riding power sweeper embodying the invention is indicated at 10. The sweeper includes a main frame or body indicated at 12 with intermediate wheels 14 and a central, rear wheel 16 which is steered by a steering wheel 18 located in front of an operator's seat 20. One or two side brooms 22 can be located in front of the wheels 14, as is known in the art, and a main rotary broom 24 is located to the rear of these wheels.

Figure 4:
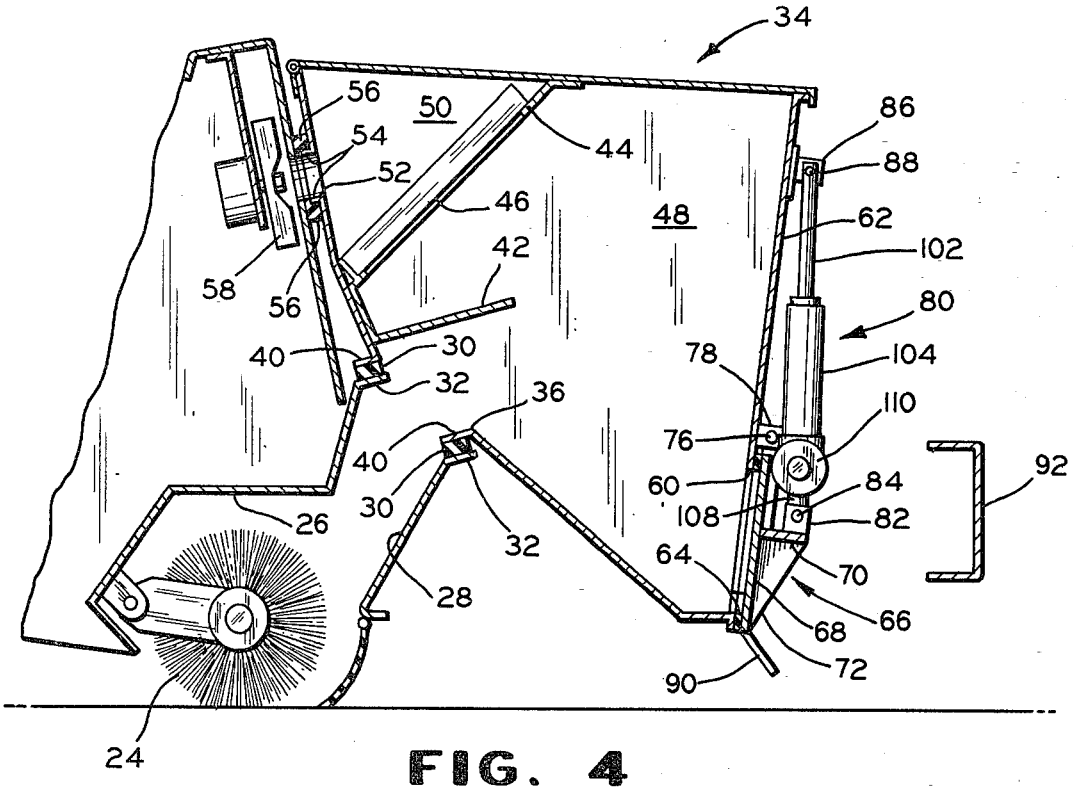
FIG. 4 is a fragmentary view in longitudinal cross section taken centrally through the hopper and a portion of the power sweeper.
Figure 5:
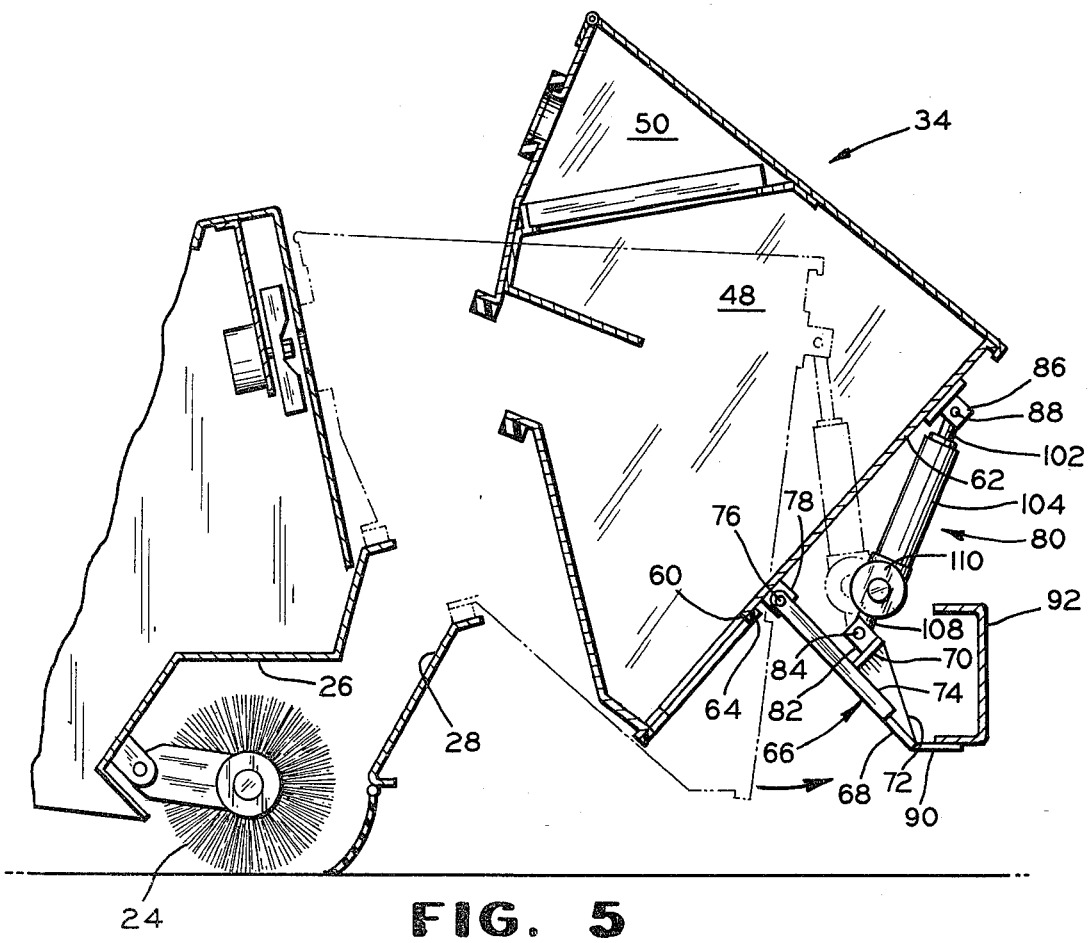
FIG. 5 is a fragmentary view in section similar to FIG. 4 but with the hopper and dumping mechanism shown in a dumping position.

Referring more particularly to FIGS. 4 and 5, the main broom 24 is located in a chamber 26 which extends across the sweeper 10. The chamber communicates with an upwardly-extending discharge passage 28 having a gasket 30 at the upper end thereof located on flanges 32.

A hopper indicaed at 34 is located in front of and above the discharge passage 28. The hopper 34 has an inlet opening 36 communicating with the discharge passage 28 and has flanges 40 which seat on the gasket 30 when the hopper is in a lowered, sweeping position. The hopper 34 also includes a deflector plate 42 above the opening 36 with a filter partition 44 and a filter 46 located above the deflector plate. The plate 42 thus prevents dirt and debris moving through the passage 28 from directly contacting the filter 46. The partition 44 and the filter 46 separate a dirt and debris chamber 48 of the hopper 34 from an exhaust chamber 50 located at the upper rear of the hopper. The chamber 50 has an exhaust opening 52 with flanges 54 which seat against a gasket 56 when the hopper is in the lowered, operating position. An exhaust blower 58 is supported on the sweeper body and draws air from the chamber 26 through the discharge passage 28, the hopper chamber 48, the filter 46, the exhaust chamber 50, and the opening 52. Airborne dirt is removed by the filter 46 and the air is suitably discharged around the blower 58.

Dirt and debris are discharged or dumped from the chamber 48 through a discharge or outlet opening 60 preferably located in a lower portion of an upright wall 62 of the hopper 34. A suitable gasket 64 is located around the opening 60 and a dumping door 66 is located near the opening 60, having a closed position against the gasket 64 and an open position spaced from the opening 60. The door 66 includes a main plate or panel 68 (see also FIG. 3) having a horizontal supporting flange 70 extending thereacross with a vertical gusset 72 therebelow. The panel 68 also has vertical edge flanges 74 at the edges which extend above the upper edge of the panel, the flanges having openings thereabove receiving an axle 76. The axle also extends through openings in spaced ears 78 which are affixed to and extend outwardly from the upright wall 62 of the hopper 34 above the opening 60. The axle 76 is held in place by outer end collars 79.

A power or drive unit indicated at 80 is connected between the door 66 and the hopper 34. More specifically, one end of the drive unit 80 is pivotally connected to the horizontal flange 70 and spaced outwardly from the door panel 68, and the other end is pivotally connected to an upper portion of the hopper wall 62. As shown, a pair of ears 82 extend upwardly from a central portion of the flanges 70 and are pivotally connected to a lower end of the drive unit 80 by a pin 84. Similarly, a pair of ears 86 are affixed to and extend outwardly from an upper portion of the wall 62 and are pivotally connected to an upper end of the drive unit 80 by a pin 88.

Figure 3:
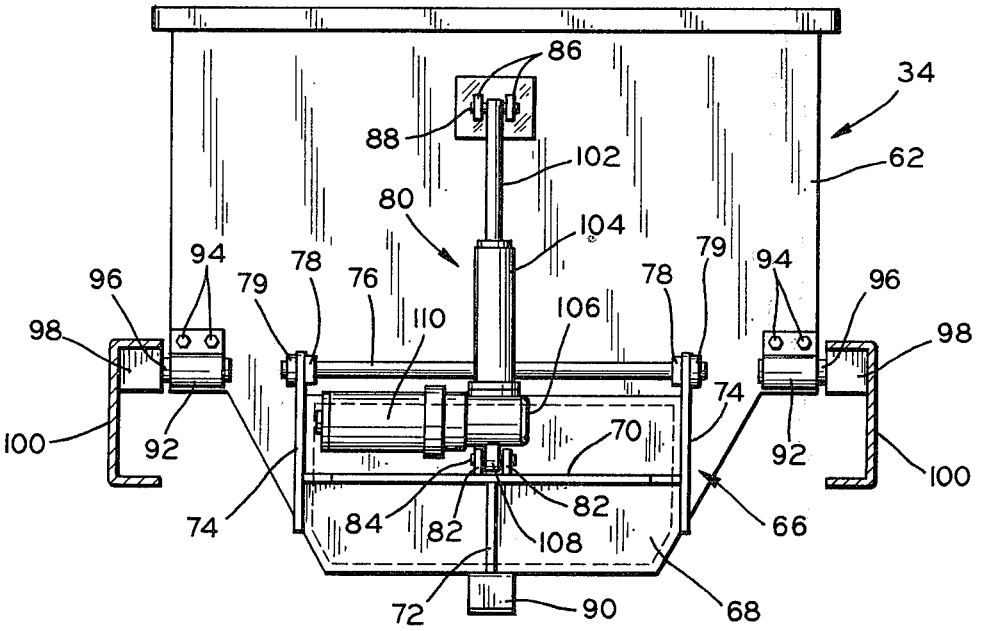
FIG. 3 is an enlarged, front view in elevation of the hopper and dumping mechanism of the sweeper.

When the drive unit 88 is extended fully, the hopper 34 is in the lower, operating position and the door 66 is tightly against the gasket 64. As the drive unit 80 is contracted, the door 66 moves in a counterclockwise direction, as shown in FIG. 5, about the axle 76. This movement continues until stop means on the door 66, shown as a depending tab 90, engages an immovable object, being a front frame member 92 of the sweeper frame 12, in this instance. Since the door 66 can then move no further relative to the frame of the sweeper, the hopper 34 is forced to pivot toward a tilted dumping position. The hopper 34, as shown in FIG. 3, has pivot brackets 92 affixed to edge portions of the hopper wall 62 by suitable fasteners 94. Pivot pins 96 extend through the brackets 92 and are affixed by mounting blocks 98 to side frame members 100 of the sweeper frame 12. With the contracting movement of the drive unit 80, the hopper 34 thus pivots about the pins 96 to the dumping position shown in FIG. 5. During dumping, a vibrator (not shown) adjacent the filter 46 can be operated to shake dirt from the filter, with this dirt also then being emptied from the chamber 48.

After dumping is completed, the drive unit 80 is again extended. At this time, the weight of the hopper 34 causes it to first pivot in a counterclockwise direction to its lowered, operating position in which the flanges 40 engage the gasket 30 and the flanges 54 engage the gasket 56. Then, further extension of the drive unit 80 causes the door to move in a clockwise direction back to its closed position, as shown in FIG. 4. A limit switch (not shown) can be positioned adjacent the outlet opening 60 to automatically shut off the drive unit 80 when the switch is engaged by the door 66.

From the above, it will be seen that the opening of the dumping door and the tilting of the hopper to the dumping position is accomplished by one drive unit and without numerous linkages. As shown, the drive unit 80 is a commercially-available linear actuator. It includes an upper rod 102 pivotally connected at its upper end by the pin 88 to the ears 86. The rod extends into a cylindrical housing 104 having a gear housing 106 at its lower end. The housing 106 is pivotally connected through a block 108 to the pin 84 and the ears 82.

The gear housing 106 is connected to a motor 110. When the motor 110 is driven in one direction, the rod 102 is caused to contract into the cylindrical housing 104, thus opening the door 66 and then tilting the hopper 34. When the motor 110 is driven in the opposite direction, the rod 102 extends from the housing 104, so that the hopper 34 moves back to its lowered, operating position and the dumping door 66 is then closed.

Other drive units can be employed in place of the linear actuator. For example, a fluid-operated ram can be used or even a pulley arrangement, which is either power driven or operated by the sweeper operator.

As shown in FIGS. 1 and 2, a cover 112 can be mounted on the upright wall 62 of the hopper 34 for design and safety purposes.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. A surface cleaning machine comprising a frame, a hopper having an outlet opening, means pivotally supporting said hopper on said frame for pivotal movement about a horizontal axis, a door, means pivotally connecting said door to said hopper, said door closing off said outlet opening when in a closed position, said machine having stop means engageable with said door when said door is pivotally moved away from said opening, drive means having one portion connected to said machine and another portion connected to said door to open said door when said drive means is actuated, said door being positioned so that when said door engages said stop means, continued actuation of said drive means causes said hopper to pivot about said pivotal supporting means toward a dumping position.

2. A surface cleaning machine according to claim 1 characterized by said one portion of said drive means being pivotally connected to said hopper of said machine.

3. A surface cleaning machine according to claim 1 characterized by said machine having a rotary broom, said hopper having an inlet opening communicating with said broom, and said hopper having a wall spaced from said inlet opening with said outlet opening being located in a lower portion of said wall.

4. A surface cleaning machine according to claim 3 characterized by said one portion of said drive means being pivotally connected to said hopper wall.

5. A surface cleaning machine according to claim 1 characterized by said stop means being on said frame.

6. A surface cleaning machine comprising a frame, wheel means supporting said frame above the floor, a rotary broom rotatably carried by said frame, a hopper carried by said machine, said hopper having an inlet opening communicating with said broom and an outlet opening spaced from said inlet opening, a door, means movably connecting said door to said hopper, said door closing off said outlet opening when in a closed position, said machine having stop means engagable with said door when moved away from said outlet opening, drive means having one end connected to said hopper and another end connected to said door to open said door when said drive means is actuated, said door being positioned so that when said door engages said stop means, continued actuation of said drive means causes said hopper to move toward a dumping position.

7. A surface cleaning machine according to claim 6 characterized by said hopper having a wall spaced from said inlet opening, said outlet opening being located in a lower portion of said wall.

8. A surface cleaning machine according to claim 7 characterized by said one end of said drive means being pivotally connected to said hopper wall.

9. A surface cleaning machine according to claim 6 characterized by said hopper being carried by said machine through pivotal means supporting said hopper near said outlet opening on said frame.

10. A surface cleaning machine according to claim 6 characterized by said stop means being on said frame.

11. A surface cleaning machine according to claim 10 characterized by said door having a tab which engages said stop means.

12. A surface cleaning machine according to claim 6 characterized by said drive means being a linear actuator.

13. A surface cleaning machine according to claim 6 characterized by said movable door connecting means pivotally connects said door to said hopper.

14. A surface cleaning machine according to claim 13 characterized by said movable door connecting means pivotally connects said door to said hopper adjacent an upper edge of said outlet opening.

* * * * *